US009664022B2

(12) United States Patent
Sood

(10) Patent No.: US 9,664,022 B2
(45) Date of Patent: May 30, 2017

(54) CONVECTIVE SAGD PROCESS

(71) Applicant: Cenovus Energy Inc., Calgary (CA)

(72) Inventor: Arun Sood, Calgary (CA)

(73) Assignee: Cenovus Energy Inc., Calgary (CA)

( * ) Notice: Subject to any disclaimer, the term of this patent is extended or adjusted under 35 U.S.C. 154(b) by 346 days.

(21) Appl. No.: 14/572,673

(22) Filed: Dec. 16, 2014

(65) Prior Publication Data

US 2015/0167435 A1 Jun. 18, 2015

Related U.S. Application Data

(60) Provisional application No. 61/916,995, filed on Dec. 17, 2013.

(51) Int. Cl.
*E21B 43/24* (2006.01)
*E21B 43/30* (2006.01)

(52) U.S. Cl.
CPC ..... *E21B 43/2406* (2013.01); *E21B 43/24* (2013.01); *E21B 43/305* (2013.01)

(58) Field of Classification Search
CPC ..... E21B 43/24; E21B 43/162; E21B 43/164; E21B 43/166; E21B 43/168; E21B 43/2406; E21B 43/2408; E21B 43/305
See application file for complete search history.

(56) References Cited

U.S. PATENT DOCUMENTS

| | | | | |
|---|---|---|---|---|
| 8,196,661 | B2 | 6/2012 | Kaiser et al. | |
| 2006/0185848 | A1* | 8/2006 | Surjaatmadja | C09K 8/68 166/280.2 |
| 2010/0126720 | A1* | 5/2010 | Kaiser | E21B 43/305 166/268 |
| 2013/0032336 | A1* | 2/2013 | Abbate | E21B 43/24 166/250.01 |

FOREIGN PATENT DOCUMENTS

| | | |
|---|---|---|
| CA | 1130201 | 8/1982 |
| CA | 2618181 | 3/2011 |
| CA | 2769044 | 2/2012 |
| CA | 2549614 | 11/2014 |
| WO | WO 2013/124744 | 8/2013 |

* cited by examiner

*Primary Examiner* — Cathleen Hutchins
(74) *Attorney, Agent, or Firm* — Knobbe Martens Olson & Bear LLP

(57) ABSTRACT

The present disclosure describes a recovery process using injector and producer wells, each well having means for varying the axial resistance to fluid flow to provide a complementary first and second annular axial fluid flow resistance profile. The recovery mechanism includes a gravity drainage component and also includes a convective flow mechanism which operate concurrently.

18 Claims, 6 Drawing Sheets

Pressure Profile

Temperature Profile

CONVECTIVE SAGD PROCESS

INCORPORATION BY REFERENCE OF RELATED APPLICATIONS

This application claims the benefit of priority of U.S. Provisional Patent Application No. 61/916,995 filed Dec. 17, 2013, which is incorporated herein by reference in its entirety.

FIELD

The present disclosure relates generally to hydrocarbon recovery processes and particularly to thermal recovery and thermal/solvent recovery processes that may be applied in viscous hydrocarbon reservoirs, and specifically in oil sands reservoirs.

BACKGROUND

Among the deeper, non-minable deposits of hydrocarbons throughout the world are extensive accumulations of viscous hydrocarbons. In some instances, the viscosity of these hydrocarbons, while elevated, is still sufficiently low to permit their flow or displacement without the need for extraordinary means, such as the introduction of heat or solvents. In other instances, such as in Canada's bitumen-containing oil sands, the hydrocarbon accumulations are so viscous as to be practically immobile at native reservoir conditions. As a result, external means, such as the introduction of heat or solvents, or both, are required to mobilize the resident bitumen and subsequently harvest it.

A number of different techniques have been used to recover these hydrocarbons. These techniques include steam flood, (i.e., displacement), cyclic steam stimulation, steam assisted gravity drainage (SAGD), and in situ combustion, to name a few. These techniques use different key mechanisms to produce hydrocarbons.

Commercially, the most successful recovery technique to date in Canada's oil sands is Steam Assisted Gravity Drainage (SAGD), which creates and then takes advantage of a highly efficient fluid density segregation, or gravity drainage, mechanism in the reservoir to produce oil. A traditional system which is a concomitant of the SAGD process is the SAGD well pair. It typically consists of two generally parallel horizontal wells, with the injector vertically offset from and above the producer.

SAGD was described by Roger Butler in his patent CA 1,130,201 issued Aug. 24, 1982 and assigned to Esso Resources Canada Limited. Since that time, numerous other patents pertaining to aspects and variations of SAGD have been issued. Also, many technical papers have been published on this topic.

The SAGD process, as embodied in the operation of a well pair, and as applied in an oil sand, typically involves first establishing communication between the upper and lower horizontal wells. There are both thermal and non-thermal techniques for establishing this inter-well communication. Subsequent to the establishment of this inter-well communication, steam is injected into the overlying horizontal well on an ongoing basis. Due to density difference, the steam tends to rise and heat the oil sand, and thereby mobilizes the resident bitumen. The mobilized bitumen is denser than the steam, and tends to move downward towards the underlying horizontal well from which it is then produced. By operating the injector and the producer under appropriately governed conditions, it is possible to use the density difference to counteract the tendency of more mobile fluids to channel or finger downward through the less mobile fluids and thereby overwhelm the producing well. Thus, in traditional SAGD operations, each well in the well pair has a specific and distinctive role in ensuring that the efficiencies which can be achieved with a gravity-dominated process are realized.

To achieve this efficiency, and avoid channeling or fingering in conventional SAGD, the flux (i.e., volume rate per unit of well length) must necessarily be limited. Therefore, to restrict the flux and still realize commercial rates, the horizontal wells must be long (e.g., 700 to 1000 meters). This well length requirement poses its own set of problems. Because there are pressure differences along the length of wellbore from heel to toe, flow from the injector into the reservoir and subsequently from the reservoir into the producer is not normally uniform along the length of the wells. This can result in a maldistribution of temperatures, or "hot spots", along the length of the wells, and can require constraints in operations at the producer to avoid inflow of live steam into the producer.

With respect to the challenge of achieving more beneficial fluid distribution along the length of the horizontal wellbores, numerous configurations have been publicly disclosed. They describe devices and techniques which influence flow geometry by altering or governing the relationship between cross-sectional area to flow, surface area with which the fluids come into contact (i.e., friction), and the change in flow volume along the wellbore as wellbore fluids exit the wellbore and enter the reservoir, or conversely, at specially chosen locations along the length of the wellbore.

Another salient challenge in conventional SAGD operations involves non-condensing gases (NCGs). These evolve or are created within the reservoir during the course of the SAGD process and can interfere seriously with heat transfer between the steam and bitumen. With respect to the challenges of reducing or minimizing the deleterious effects of non-condensing gas in impeding heat transfer between the injected steam and the bitumen, and to means of controlling fluid distribution along the wellbore, the following disclosures have described certain approaches to these problems.

CA 2,618,181 to Struyk et al, assignee FCCL Partnership, and titled "Downhole Steam Injection Splitter" describes a device which singularly or in plurality may be installed along the tubing string of an injection well. The installed module includes a port whose size can be selected or designed to permit injected fluids to exit the well and enter the reservoir at a specified rate for a given set of conditions. A plurality of such modules, each with its individually designed port, can achieve a specific injection (outflow) profile and can, for example, provide a means of achieving uniform flow along the injection wellbore. Struyk is concerned with the profile of fluid distribution of only those fluids exiting the injection wellbore.

U.S. Pat. No. 8,196,661 to Trent et al, assignee Noetic Technologies Inc., and titled "Method for Providing a Preferential Specific Injection Distribution from a Horizontal Injection Well" offers another example of a method and system for governing flow distribution of fluid along the length of a well and subsequent injection of that fluid into the reservoir. As with CA 2,618,181, this disclosure describes a method that uses an injection well only and is concerned with the distribution of flow along that injection wellbore only insofar as that flow exits the wellbore and enters the reservoir. No wellbore configuration or method of well operations is specified in the Noetic patent whereby the injected fluids will then enter the production well in a specified way.

CA 2,769,044 to Butland et al, assignee Alberta Flux Solutions Ltd., and titled "Fluid Injection Device", describes a device or system for distributing fluids, including steam, along an injection-only wellbore with radially outward flow into the formation. Also, it references devices or approaches which modify the flow resistance within the wellbore to assist in the distribution of injected fluids.

These systems with injection only from the horizontal wellbore into the reservoir are focused on the flow geometry of only the injected fluids into the reservoir without any concern for the flow geometry within the associated production wellbore, or more specifically from the reservoir into the production wellbore.

WO 2013/124744 to Stalder, assignees ConocoPhillips and Total, and titled "SAGD Steam Trap Control", teaches the use of devices such as those described above in which flow is controlled, but includes both outflow from the injector and inflow into the producer. A key teaching of this patent application is that the horizontal injection and production wells are spaced apart at a vertical distance of 3 meters or less. The use of flow control to restrict the flow of steam vapor is cited. While Stalder mentions the use of flow control devices in both the injector and producer wells, there is no specific geometry in relation to flow control, along and between the wells, that is stipulated.

A follow-up publication by Stalder titled "Test of SAGD Flow Distribution Control Liner System, Surmont Field, Alberta, Canada", and designated SPE 153706, was presented in Mar. 2012 at the SPE Western Regional Meeting, approximately one month after the priority date of the abovementioned patent application to Stalder. The paper discusses actual field experience in attempting to achieve more uniform distribution of steam within the reservoir and describes the use of ports designed to control the distribution of flow along the length of the wellbores.

A paper titled "Investigation of Key Parameters in SAGD Wellbore Design and Operation" by Vander Valk and Yang, published in the Journal of Canadian Petroleum Technology (JCPT), Jun. 2007, Volume 46, No. 6, presents the results of a comprehensive investigation of pressure distribution along the wellbores and associated well completion methods. The paper recognizes the effects of fluid resistance in the wellbore on SAGD performance. Means of altering fluid resistance in the wellbore, such as choices of tubular diameter, the use of steam ports and limited entry perforations are discussed.

With respect to means of removing unwanted non-condensing gas from the reservoir, CA 2,549,614 encompasses three salient approaches. Specifically, CA 2,549,614 to Nenniger, assignee N-Solv, and titled "Methods and Apparatuses for SAGD Hydrocarbon Production" proposes to move the non-condensing gas away from the active sites within the reservoir where it can interfere with the heat transfer between steam and bitumen. Firstly, it proposes to remove this non-condensing gas component by a convective displacement process involving steam as the displacing agent. Secondly, it proposes the use of a vent well placed within the reservoir so that the non-condensing gases may be vented. Thirdly, it proposes to remove the non-condensing gases from the active steam-bitumen heat transfer site by modifying the buoyancy of the non-condensing gas, for instance by injecting hydrogen.

None of these earlier disclosures, whether related to controlling the distribution of fluids along the length of the well, or whether addressing the issue of non-condensing gases, describes a method and system whereby both the fluid distribution problem and the non-condensing gas problem are beneficially resolved concurrently.

BRIEF DESCRIPTION OF DRAWINGS

The present recovery processes disclosed herein will be described with reference to the following drawings, which are illustrative and not limiting.

SUMMARY

Figure 1:
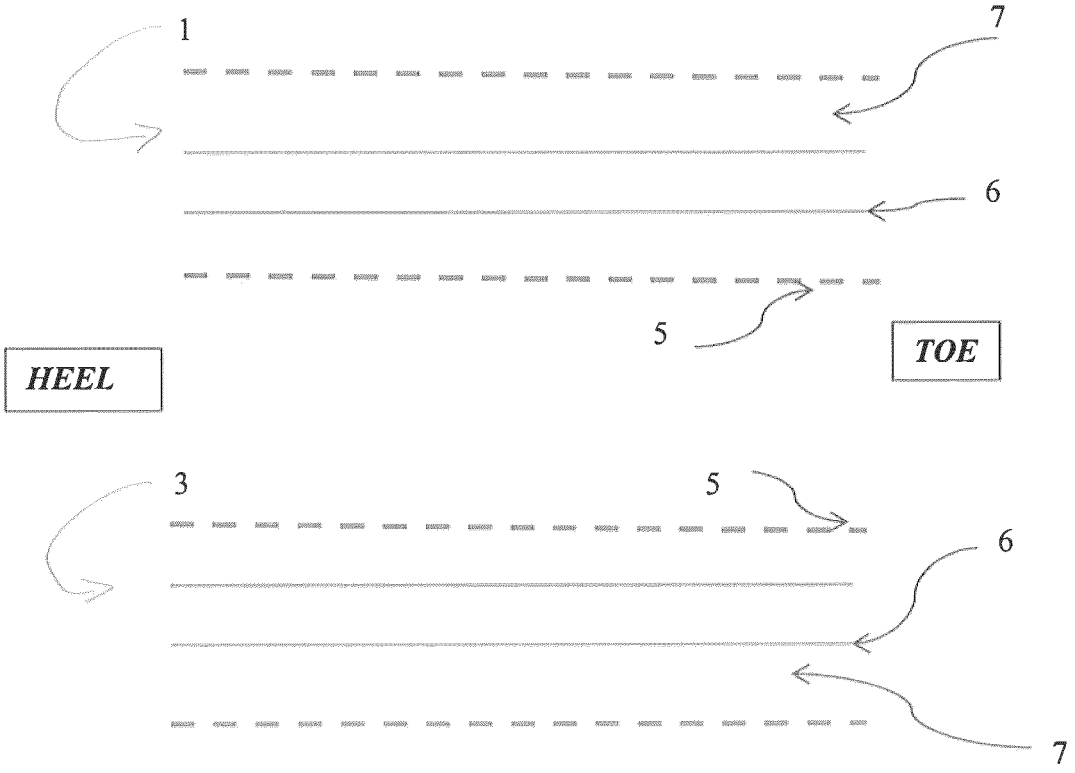
FIGURE 1 PRIOR ART
FIG. 1 shows a prior art use of a horizontal well pair in a SAGD recovery process in which tubulars within the wellbore are of uniform diameter.

The present disclosure provides a recovery process and system for recovering hydrocarbons from subterranean formations. The process and system overcomes at least one of the disadvantages from prior processes.

The present disclosure provides a process for the recovery of viscous hydrocarbons from a subterranean reservoir, typically involving a well pair whose trajectories are separate but aligned, with the injection and production wellbores having been configured so that the trend in resistance to fluid flow axially along the annular region of one wellbore exhibits a complementarity relative to the trend in resistance to fluid flow axially along the annular region of the other wellbore. The operation of a well pair thus configured results in a recovery process that includes the benefit of a gravity drainage mechanism, while also including a significant component of convective displacement. The convective displacement mechanism, when generated according to the teaching of the present disclosure, is associated with an improved distribution of fluids along the length of the wells and in the reservoir, and of the temperature of those fluids, thereby facilitating the production of liquid hydrocarbons. In addition, when non-condensing gases are present in the reservoir, which gases typically represent an impediment to the efficient transfer of heat from the steam to the cold bitumen, the system and method of the present disclosure achieves an improved removal of those unwanted non-condensing gases from the reservoir. In those instances where the reservoir contains heterogeneities, such as localized shale features, the convective displacement aspect of the present disclosure, with its ability to effect horizontal displacement, also improves performance relative to that achieved by conventional SAGD in the same reservoir setting.

It should be noted that the advantages of the system and method described in the present disclosure, while clearly evident where non-condensing gases are present in the reservoir, or where localized shale features occur within a reservoir, are realized even in the absence of these special circumstances. Thus, in a situation where non-condensing gas is absent, and where the reservoir is entirely homogeneous, the system and method of the present disclosure will lead to performance that is an improvement over that which can be achieved with the more conventional recovery process counterpart.

In one aspect, the present disclosure provides a method of producing viscous hydrocarbons from a subterranean formation, comprising the steps of: i) providing a first well within the subterranean formation wherein the well includes an annular region, defined by an inner surface of an outer wall which has hydraulic access to the reservoir through said wall, and an outer surface of an inner wall; ii) providing means of varying an axial resistance to fluid flow within the annular region of the first well along at least a portion of a length of the first well, said variation in axial resistance to fluid flow constituting a first annular axial fluid resistance profile; iii) providing a second well, at least a portion of which is aligned with and spaced apart from the first well, the second well including an annular region, defined by an inner surface of an outer wall which has hydraulic access to the reservoir through said wall, and an outer surface of an inner wall; iv) providing means of varying an axial resistance to fluid flow within the annular region of the second well along at least a portion of a length of the second well, said variation in axial resistance to fluid flow constituting a second annular axial fluid resistance profile, wherein the second annular axial fluid resistance profile is complementary to the first annular axial fluid resistance profile of the first well; v) injecting one or more mobilizing fluids into the first well, said one or more mobilizing fluids flowing through the means of varying the axial resistance to fluid flow in the first well; and vi) producing one or both of the one or more mobilizing fluids and mobilized fluids, comprising the viscous hydrocarbons, from the second well through the at least a portion of the second well having the means of varying the axial resistance to fluid flow, and operating the first well and the second well so that gravity drainage and convective displacement are employed concurrently in recovering the viscous hydrocarbons.

In a further aspect, the present disclosure also provides a system for producing hydrocarbons from a subterranean formation, comprising: i) a first well within the subterranean formation wherein the well includes an annular region defined by an inner surface of an outer wall which is configured to have hydraulic access to the reservoir through said wall, and an outer surface of an inner wall; ii) means for varying the axial resistance to fluid flow within the annular region of the first well along at least a portion of a length of the first well, said variation in axial resistance to fluid flow constituting a first annular axial fluid resistance profile; iii) a second well within the subterranean formation wherein the well includes an annular region defined by an inner surface of an outer wall which is configured to have hydraulic access to the reservoir through said wall, and an outer surface of an inner wall; and iv) means for varying the axial resistance to fluid flow within the annular region of the second well along at least a portion of a length of the second well, said variation in axial resistance to fluid flow constituting a second annular axial fluid resistance profile, wherein the second annular axial fluid resistance profile is complementary to the first annular axial fluid resistance profile.

In another aspect described herein, a method of producing viscous hydrocarbons from a subterranean formation, comprises providing a first well within the subterranean formation wherein the well includes an annular region, defined by an inner surface of an outer wall which has hydraulic access to the reservoir through said wall, and an outer surface of an inner wall, providing a first axial resistance to fluid flow varier within the annular region of the first well along at least a portion of a length of the first well, wherein the variation in axial resistance to fluid flow constituting a first annular axial fluid resistance profile, providing a second well, at least a portion of which is aligned with and spaced apart from the first well, the second well including an annular region, defined by an inner surface of an outer wall which has hydraulic access to the reservoir through said wall, and an outer surface of an inner wall, providing a second axial resistance to fluid flow varier within the annular region of the second well along at least a portion of a length of the second well, wherein the variation in axial resistance to fluid flow constituting a second annular axial fluid resistance profile, wherein the second annular axial fluid resistance profile is complementary to the first annular axial fluid resistance profile of the first well, injecting one or more mobilizing fluids into the first well, said one or more mobilizing fluids flowing through the first axial resistance to fluid flow varier in the first well, and producing one or both of the one or more mobilizing fluids and mobilized fluids, comprising the viscous hydrocarbons, from the second well through the at least a portion of the second well having second axial resistance to fluid flow varier, and operating the first well and the second well so that gravity drainage and convective displacement are employed concurrently in recovering the viscous hydrocarbons.

In some embodiments, the first annular axial fluid resistance profile is complementary to the second annular axial fluid resistance profile when, i) over an interval of increasing axial resistance to fluid flow in the first well there is a decreasing axial resistance to fluid flow in the second well, or ii) over an interval of decreasing axial resistance to fluid flow in the first well there is an increasing axial resistance to fluid flow in the second well.

In some embodiments, the amount of increase in the axial resistance to fluid flow in one well substantially corresponds to the amount of decrease in the axial resistance to fluid flow in the other well.

In some embodiments, the increase and/or decrease in axial resistance to fluid flow is monotonic.

In some embodiments, the increase and/or decrease in axial resistance to fluid flow is non-monotonic.

In some embodiments, the axial resistance to fluid flow varier comprises at least one of: a length of tubing with a progressive increase or decrease in diameter in the axial direction, wherein the progressive increase or decrease is continuous or step-wise; a liner whose inner surface defines an outer boundary of the annular region, and which contains openings that penetrate the wall of the liner such that the size, shape, configuration and distribution of those openings provide a desired variation in annular axial fluid resistance when fluids flow in the annular region; a modified outer surface of the inner wall of the annular region, or a modified an inner surface of the outer wall of the annulus to introduce additional frictional effects within the annular region; and a flow geometry modifier within the annular region.

In some embodiments, the first and second axial resistance to fluid flow variers are the same or different, with the proviso that the first and second annular axial fluid resistance profiles are complementary.

In some embodiments, the viscous hydrocarbons are selected from the group consisting of bitumen, heavy oil, and unmobilized hydrocarbons.

In some embodiments, the injected fluid comprises steam, hot water, light hydrocarbons, or mixtures thereof or one or more of non-condensing gases and surfactants.

In another aspect described herein, a system for producing hydrocarbons from a subterranean formation, comprises a first well within the subterranean formation wherein the well includes an annular region defined by an inner surface of an outer wall which is configured to have hydraulic access to the reservoir through said wall, and an outer surface of an inner wall; a first axial resistance to fluid flow varier within the annular region of the first well along at least a portion of a length of the first well configured to generate a variation in axial resistance to fluid flow constituting a first annular axial fluid resistance profile; a second well within the subterranean formation wherein the well includes an annular region defined by an inner surface of an outer wall which is configured to have hydraulic access to the reservoir through said wall, and an outer surface of an inner wall; and a second axial resistance to fluid flow varier within the annular region of the second well along at least a portion of a length of the second well, configured to generate a variation in axial resistance to fluid flow constituting a second annular axial fluid resistance profile; wherein the second annular axial fluid resistance profile is complementary to the first annular axial fluid resistance profile.

In some embodiments, the first annular axial fluid resistance profile is complementary to the second annular axial fluid resistance profile when, i) over an interval of increasing axial resistance to fluid flow in the first well there is a decreasing axial resistance to fluid flow in the second well, or ii) over an interval of decreasing axial resistance to fluid flow in the first well there is an increasing axial resistance to fluid flow in the second well.

In some embodiments, the amount of increase in the axial resistance to fluid flow in one well substantially corresponds to the amount of decrease in the axial resistance to fluid flow in the other well.

In some embodiments, the increase and/or decrease in axial resistance to fluid flow is monotonic. The system of claim 10 wherein the increase and/or decrease in axial resistance to fluid flow is non-monotonic.

In some embodiments, the first and second axial resistance to fluid flow variers comprises at least one of a length of tubing with a progressive increase or decrease in diameter in the axial direction, wherein the progressive increase or decrease is continuous or step-wise; a liner whose inner surface defines an outer boundary of the annular region, and which contains openings that penetrate the wall of the liner such that the size, shape, configuration and distribution of those openings provide a desired variation in annular axial fluid resistance when fluids flow in the annular region; one or more of a modified outer surface of the inner wall of the annular region, or a modified inner surface of the outer wall of the annulus to introduce additional frictional effects within the annular region; and a flow geometry modifier within the annular region.

In some embodiments, the first and second axial resistance to fluid flow variers are the same or different, with the proviso that the first and second annular axial fluid resistance profiles are complementary.

In some embodiments, the viscous hydrocarbons are selected from the group consisting of bitumen, heavy oil, and unmobilized hydrocarbons.

The system of claim 10 wherein the injected fluid comprises steam, hot water, light hydrocarbons, or mixtures thereof or one or more of non-condensing gases and surfactants

DETAILED DESCRIPTION

In the following discussion, references to words like "improved" or "better" are intended to convey the improvement in performance achieved by practicing the system and method of the present disclosure relative to the performance of its conventional counterpart. Thus, when referring to the improved performance achieved with the present disclosure as applied in the steam mode, the implication is that this performance represents an improvement relative to the conventional gravity-based steam method (i.e., SAGD). When used in steam mode, we refer to the system and method of the present disclosure as Convective SAGD.

In the present disclosure, reference to a well pair implies two wells whose trajectories within the reservoir are separate, but exhibit substantial alignment with each other, though not necessarily strict parallelism. It is further understood that the two wells are, or are being hydraulically connected to each other, and may be oriented horizontally, or vertically, or at an angle intermediate between the two. However, for simplicity of illustration, most of the following description will refer to an embodiment which involves horizontal wells.

The present method and system applies a complementarity principle in designing and creating the axial fluid resistance profiles in the annuli of an injector-producer well pair. Specifically, if a certain profile of fluid resistance axially along the annulus of an injection wellbore is selected, then the profile in the producing wellbore annulus is made to bear a complementary relationship to the profile of the injector. Thus, for example, in an embodiment involving horizontal or inclined wells, if the annular axial resistance to fluid flow in the injector were selected so as to increase monotonically from heel to toe, the annular axial resistance to fluid flow in the producer would be made intentionally to decrease monotonically from heel to toe. In some embodiments, the change may not be monotonic. Where complementarity is observed, a non-monotic progression of fluid resistance can be employed so long as the principle of complementarity is observed. For example, one could choose to increase the annular axial resistance to fluid flow in the injector from heel to the mid-point of the well length and decrease the annular axial resistance to fluid flow in that same injector from the mid-point to the toe. Under the principle of complementarity taught in the present disclosure, one would configure the annulus of the producing wellbore so that the axial resistance to fluid flow would decrease from the heel to the mid-point and then increase from the mid-point to the toe. Other non-monotonic configurations, and other well trajectory orientations, could be practiced, however always including the feature of complementarity with respect to annular axial resistance to fluid flow.

As employed in the present disclosure, the noun "complementarity", and its adjectival form "complementary", refer to a specific type of spatial relationship. Complementarity is defined in terms of trends in annular axial resistance to fluid flow along the length of a well. Viewed mathematically, a positive slope in the axial trend of annular resistance to fluid flow in a first well is complemented by a negative slope in the axial trend of annular resistance to fluid flow over the corresponding interval in a second well. For example, there is a resistance to fluid flow within the annulus along the length of a horizontal well (i.e., in the axial direction), which well is one well of a well pair, such as a SAGD well pair. During operations, when fluids are flowing within the annulus of each well, the resistance to fluid flow within the annulus at a given time will, in general, assume different values along the length or axis of each well (i.e., in the axial direction). For purposes of a complementarity in spatial relationship, the value or function of interest at any given time is the trend or directional change in this annular resistance to fluid flow along the length or axis of the well. Stated otherwise, the function of interest is the direction of the axial trend in annular resistance to fluid flow. Thus, if the annular resistance to fluid flow at a given time increases axially in the direction of, for example, heel to toe along a particular length segment of the first well of a well pair, the spatial change over that segment is positive. Correspondingly, if the resistance to fluid flow at that same time decreases from heel to toe axially within the annulus along the corresponding length segment of the second well, the trend in annular resistance to fluid flow at that time over the corresponding length segment of the second well is negative. This type of inverse correspondence between the axial trends in the annular resistance to fluid flow in corresponding segments of the two wells of a well pair is referred to within the present disclosure as complementarity. Thus, under these described circumstances, the trends in annular fluid resistance in the axial direction within the two wells are said to be complementary.

In some cases, it may not be practical to achieve precise alignment such that a vertical projection from the extremities of the first well length segment aligns exactly with the extremities of the second well length segment. In a practical situation in the field, equipment limitations or operating considerations may result in wellbore configurations where, over a limited length segment interval, the annular axial resistance to fluid flow in the two wells may deviate from strict complementarity. For example, a geometrically projected corresponding length interval and the actual corresponding length interval as installed in a formation may deviate and would be considered a localized excursion in complementarity. In a further example, referring to the use of telescoping tubing within each well, it may be necessary or advisable to insert a limited length of tubing in one well such that the joint interrupts an otherwise axially monotonic increase or decrease in tubing diameter to accommodate some wellbore limitation or operating circumstance and, in so doing, causes a deviation from complementarity over this interval. A simulated case in which complementarity was maintained over most of the length of an 800 meter long well, except for a 50 meter length of tubing in the producer which deviated from the monotonic trend, and therefore caused a corresponding deviation from complementarity over this interval, demonstrated that there was no measurable impact on the performance of the SAGD well pair under these circumstances. Thus, the benefits which ensue from maintaining complementarity are substantially preserved in those instances where small excursions from complementarity occur. Accordingly, when simulated performance of Convective SAGD involving a wellbore configuration which includes localized deviations from strict complementarity is compared with performance involving an ideally monotonic tubing string and associated ideal complementarity, and the comparison indicates that Convective SAGD, with a deviation from ideality, still achieves a clear benefit in performance compared with conventional SAGD, then complementarity would be considered to have been practiced and preserved. Therefore, localized excursions from complementarity may occur and do not necessarily detract materially from the overall benefits of the present system and method.

While the foregoing paragraph examines complementarity in terms of localized deviations, and demonstrates the robustness of the definition when such localized deviations occur, it is also instructive to examine the robustness of this definition of complementarity when applied over an extended well length, as opposed to a localized excursion. Thus, employing the example of telescoping tubing as an axial resistance to fluid flow varier, or as a means of varying annular axial resistance to fluid flow, over an entire well length, the injector tubing within the liner telescopes convergently from a diameter at the heel of 158 mm to a toe value of 114 mm. In a first instance, the liner in the producer is identical to the liner in the injector, and includes a tubing string which telescopes divergently from a heel diameter of 114 mm to a toe value of 158 mm. Because of the reversal in trend of the annular axial resistance to fluid flow between the two wells, complementarity is established. In addition, having regard to this reversal in trend, the absolute values at the extremities are identical. For example, simulations employing this configuration indicate that, after three years, cumulative steam-oil ratio (CSOR) is 1.95, compared with a value of 2.17 after that same elapsed time in the case of conventional SAGD. In a further instance, we preserved the principle of complementarity, as defined in the present disclosure, but no longer employ identical absolute values. Thus, the injector tubing is configured as before but the producer tubing telescopes divergently from a heel diameter of 114 mm to a toe diameter of only 130 mm. Again, the principle of complementarity, as herein defined is preserved, in this instance because monotonic convergence occurs in a first well and monotonic divergence occurs in the second well. However, in this instance, the absolute values of annular axial resistance to fluid flow in the producer have changed relative to those in the injector. Indeed the relative values have also changed. Notwithstanding these changes, simulations demonstrate that the CSOR after three years is 2.0—very similar to that of the case where absolute values of tubing diameter were identical between injector and producer, and still clearly superior to the value achieved with conventional SAGD. These simulations, along with others of a similar nature that were performed, verify the robustness of the definition of complementarity in terms of an axial change of given algebraic sign in annular resistance to fluid flow along the length of a first well, or portion thereof, relative to an axial change in annular resistance to fluid flow of opposite algebraic sign along the corresponding length interval of a second well.

Although the present disclosure refers to recovery processes such as thermal and/or solvent recovery processes, it will be understood by a skilled person that the present system and method, with its complementary axial progression of fluid resistance in the annuli of injector and producer, will function beneficially for a broad range of in situ recovery processes including both thermal and non-thermal processes. Examples of in situ recovery processes which may be used with the present system and method, and in which the principle of axial variation in fluid resistance along the wellbore annulus, with complementarity of resistance profile between injector and producer, may be beneficially applied include those which rely, either singly or in combination, on the injection of steam, solvents, light hydrocarbons, water, surfactants, and non-condensing gases, including both oxidizing and non-oxidizing gases. Examples of light hydrocarbons include $C_3$ to $C_{10}$ hydrocarbons such as propane, butane and pentane.

When applied in an embodiment involving a horizontal well in a steam-only process, for example, the result of employing this variation in annular axial resistance to fluid flow in one well and a complementary variation in annular axial resistance to fluid flow in the second well is a marked improvement in key performance indices, such as cumulative steam-oil ratio (CSOR) and oil production rate, relative to that achieved with conventional SAGD. As will be explained further, this improvement, as achieved by application of the teaching of the present disclosure, occurs because the variable resistance profile, combined with application of the complementarity principle taught in the present disclosure, engenders a beneficial convective displacement within the reservoir, along with the ongoing gravity drainage mechanism. The efficiency of the gravity drainage mechanism is amply documented in the literature and needs no further discussion. However, the present method and system provides an added advantage of the convective displacement mechanism relative to a process that relies purely on gravity drainage. Furthermore, if there is non-condensing gas present in the reservoir, employment of the system and practice of the method taught in the present disclosure will be especially effective in removing unwanted non-condensing gas from the reservoir and thereby further improving performance. An additional beneficial outcome in applying the present disclosure is that, when there are barriers to vertical flow that are discontinuous over the process region, so that pathways to vertical flow exist, albeit sinuous or indirect, application within that reservoir of the present disclosure in, for example, steam mode will result in improved performance when compared with application of conventional SAGD in that reservoir.

One embodiment of the present method and system involves the creation of a trend in annular axial resistance to fluid flow by varying the cross-sectional area of the annulus as follows. In this example, strictly by way of simplifying the description, and without restricting the generality of the complementarity principle, it is assumed that the liner characteristics in the injector and producer of a well pair are identical. It is assumed that the well pair is operating within a reservoir using a steam-based recovery process. By using a progression of reducing or increasing fluid resistances along the length of a well within a wellbore annulus, which variation is achieved by varying, in the axial direction, the cross-sectional area of the annulus (i.e., the area between the outer wall of a tubing string and the inner wall of a slotted liner), and by thus providing an axial variation in each of the injector and the producer of a well pair, and by reversing the axial direction of that progression of fluid resistances in the annulus of the producer relative to the progression within the annulus of the injector so as to achieve complementarity, performance of the well pair is much improved compared with that of the well pair in a conventional SAGD configuration and operation. This outcome applies in both a gassy oil situation, where non-condensing gas is present in the reservoir, and in a dead oil situation, where non-condensing gas is absent.

It should be understood that when reference is made to flow in the annulus of a wellbore, the outer boundary of that annulus may be the interior surface of a tubular artifact, such as a slotted liner. Alternatively, the outer boundary of the annulus may consist of open hole. In the case of the interior surface of a tubular artifact constituting the outer boundary of the annulus, the body of said artifact will possess openings which traverse its complete thickness, and which may be configured (e.g., sized, shaped and distributed) in various ways, such that the fluids flowing in that annulus have hydraulic access between the annulus and the reservoir via those openings, and such that the configurations of those openings are one of the determinants of the annular axial resistance to fluid flow.

Both the variation in axial fluid resistance and the complementarity of the respective fluid resistance profiles in injector and producer, as taught in the present disclosure, play a key role in improving performance of this recovery process relative to that of a gravity-dominated process such as conventional SAGD.

The axial variation in the annular fluid resistance in one well, and the application of the principle of complementarity with respect to variation in annular axial fluid resistance along the length of the other well of a well pair, results in improved SAGD performance. In conventional SAGD, the small vertical separation between injector and producer, combined with the reliance on gravity drainage as the basis for the recovery mechanism, results in a tendency of fluids to short-circuit through the reservoir from injector to producer along this vertical path. To avoid this, production inflow has to be restricted. A consequence of this restriction is that bitumen production rates are reduced, a smaller portion of the non-condensing gas is produced (i.e., removed) and, under the influence of gravity segregation, more of the non-condensing gas ascends to the walls in the upper extremities of the steam chamber and interferes with heat transfer between steam and bitumen.

By applying the principle of complementarity and, in this embodiment, creating and utilizing a reversal of the progression of fluid resistance in the two wells, a strong pressure gradient is introduced in the reservoir along the length of the well pair (i.e., axially). For example, in the case of the monotonic embodiment described above, the injector annulus may be configured so that resistance to fluid flow is increased from toe to heel. In complementary fashion, in the producer annulus, resistance to fluid flow is made to decrease from toe to heel. This complementarity results in a flow profile that encourages more steam to go into the reservoir near the toe end (i.e., low fluid resistance at the injector toe), but at the same time prevents steam, at the toe end, from finding a path of least resistance (i.e., a short circuit) directly to the producer (i.e., high fluid resistance at the producer toe) As we move towards the heel, decreasing resistance in the producer annulus allows more flow into the producer, including more low temperature fluid flow.

Where non-condensing gas is present, the foregoing arrangement encourages more non-condensing gas to be produced (than steam) as the pressure at the producer heel is decreased. Thus, the non-condensing gases are swept along this largely axial pressure gradient and are preferentially produced. Removal of the non-condensing gas from the reservoir allows injected steam, which ascends in the reservoir and moves to the edges of the steam chamber, to make more efficient contact with native bitumen, thus improving the overall performance of the gravity-dominated portion of the process. A concomitant of this convective component of the movement of fluids is that temperatures in the vicinity of the producer are reduced relative to those that occur in conventional SAGD. As a result, the occurrences of hot spots are reduced or avoided, and the associated constraints on production normally associated with SAGD are mitigated.

One may employ various methods of creating this axial progression of fluid resistance in the injector and its complementary progression in the producer (also referred to herein as means for varying axial resistance to fluid flow). For example, and as already discussed, one may cause the resistance to fluid flow within the wellbore annulus to vary by employing an internal string, such as a tubing string, whereby the tubing diameter decreases progressively, or alternatively increases progressively, along the length of the wellbore, or a segment thereof. Alternatively, one might allow piping internals, such as for example a slotted liner, to retain a uniform diameter, but nevertheless achieve the variable resistance to fluid flow along the axis of the wellbore by varying the size, shape and distribution of openings, such as liner slots or flow control devices (including both inflow control and outflow control devices). In a further alternative, a progression of friction increasers may be employed within the wellbore. These friction increasers could include roughened surfaces or more highly modified flow surfaces (e.g., flow conditioners), or could entail the use of a series of flow restrictions, or chokes, along the length of a flow conduit within the wellbore.

Any of these alternative devices, such as variation in tubing diameter, variation in size and distribution of ports or slots, or the use of friction-inducing devices such as flow conditioners, or combinations thereof, may be employed to practice the complementary, fluid resistance profiles described herein.

On advantage described in the present disclosure relates to the configuration of those devices, specifically practicing the application of a complementary relationship between annular axial resistance to fluid flow in the injector, or portion thereof, and annular axial resistance to fluid flow over the corresponding segment of the producer.

It should be further noted that the described variations in annular axial resistance to fluid flow along a wellbore may be either continuous, or step-wise, or may comprise combinations thereof. Thus, in the case of variations in tubing diameter along the length of a well, practicality would normally dictate that a given diameter would be employed over some length of wellbore, with increasing (or decreasing) diameters employed over other intervals, resulting in a step-wise increase or decrease in tubing diameter over the selected length of the well. However, other devices employed to vary flow resistance could be of a continuously varying nature.

Based on numerous simulations, the advantages of practicing the teachings of the present disclosure in the steam mode, when compared with conventional SAGD, are evident for a homogeneous reservoir. However, in a formation containing shale lenses or discontinuous features which can impede vertical flow over portions of a reservoir, the advantage of the present disclosure becomes even more apparent. This advantage involves the presence of the convective displacement mechanism which is induced by the complementary fluid resistance profiles taught by the present disclosure. With this largely horizontal convective mechanism available, ascending steam which might otherwise be impeded by a shale feature when moving only in a purely vertical direction can also migrate horizontally and, once out from under an impediment such as a shale feature, can continue its ascent. Correspondingly, descending fluids, including mobilized bitumen, will undergo horizontal displacement as a result of the convective flow mechanism and will thereby enjoy an increased opportunity to descend to the producer.

It should be noted that while application of the present disclosure is advantageous in the manner in which fluids are distributed along the length of the wells and also in the manner in which the method of the present disclosure is capable of removing non-condensing gases from the reservoir, this latter aspect is not a necessary condition for realizing a performance improvement with the present disclosure relative to conventional processes. Thus, even when non-condensing gases are absent, such as in a dead oil situation, simulations indicate that the method of the present disclosure, when applied in steam mode, still achieves an energy efficiency (e.g., steam-oil ratio) advantage over conventional SAGD.

The present system and method further apply in those situations where additional wells constitute integral elements of the conventional SAGD or solvent-assisted recovery process. For example, horizontal infill wells are frequently placed between SAGD well pairs and, in the case of adjacent steam chambers which have merged or coalesced to form a hydraulic unit, the infill wells are operated so that they also link with, and become part of, the SAGD hydraulic unit. Consider by way of example the embodiment of the present disclosure in which the axial progression of fluid resistance involves telescoping tubing in the injector, and inverse telescoping tubing in the producer in accordance with the teaching of complementarity. The infill well, or each infill well within a group of infill wells located between two adjacent well pairs, and oriented substantially parallel to them, may be equipped with an annular fluid resistance modifier that accords with the progression utilized in the SAGD producer. Thus, the principle of complementarity for a well pair that underpins some of the teachings of the present disclosure is maintained in an infill well, albeit with an axial progression of fluid resistance in one direction along the SAGD injector wellbore and an inverse progression in both the SAGD producer wellbore and the associated infill producer wellbore or wellbores.

Throughout this disclosure, reference is made to one embodiment of a well trajectory involving horizontal wells. In one aspect, a horizontal well implies a well that is substantially or predominantly horizontal, but may include sections or segments that are not horizontal. The lack of horizontality over portions or segments of the well length may occur as a result of technology limitations, or may be intentional, for example when steering the well path so that it avoids a particular adverse geological feature, or so that it creates a useful structural low point for fluid accumulation, such as a sump. This characterization of a well as horizontal, notwithstanding possible deviations from horizontality over segments or portions of the well length, is well known to those skilled in the art.

Also, as already noted, application of the teaching of complementarity described in the present disclosure also applies to vertical wells, or to wells whose trajectories are oriented at angles intermediate between these two.

FIG. 1 illustrates schematically the horizontal portion of an injection wellbore 1 (injector) or a production wellbore 3 (producer) in a conventional SAGD well pair. The tubulars within the wellbores, such as the slotted liner 5 or tubing are of substantially uniform diameter and are typically configured to maximize exposure of the well to the reservoir, and to provide openings, such as slots or ports, through which injected fluids may exit the injector and enter the reservoir or through which produced fluids may move from the reservoir into the producer. The schematic representation of one tubular 6 being centered within a larger tubular is intended for simplicity of illustration only. In the absence of any special guiding devices within the wellbore, the smaller tubular may be positioned eccentrically within the larger tubular. Alternatively, a wellbore guiding device, such as a centralizer, may be used, either singly or in a multiplicity, to maintain a degree of concentricity of the smaller tubular within the larger tubular.

As described earlier with reference to prior technology, the internals of the injector or producer may be modified to achieve various ends. For example, resistance to fluid flow in the annulus 7 along the axial direction within the wellbore may be modified to achieve a more uniform distribution of exiting or entering fluids along the length of the wellbore. These modifications can be achieved, for example, by techniques that vary tubular diameters, the sizes, shapes and distribution of openings between the well and the reservoir, and the characteristics of roughness or friction inducement along surfaces contacted by the flowing fluids. Similarly, one may design wellbore internals, such as tubular diameters, slots, ports, specialized inflow and outflow devices, and surface roughness features, to distribute flow along the length of an injector or producer having regard to spatial non-uniformities in reservoir properties (i.e., heterogeneity).

Figure 2:
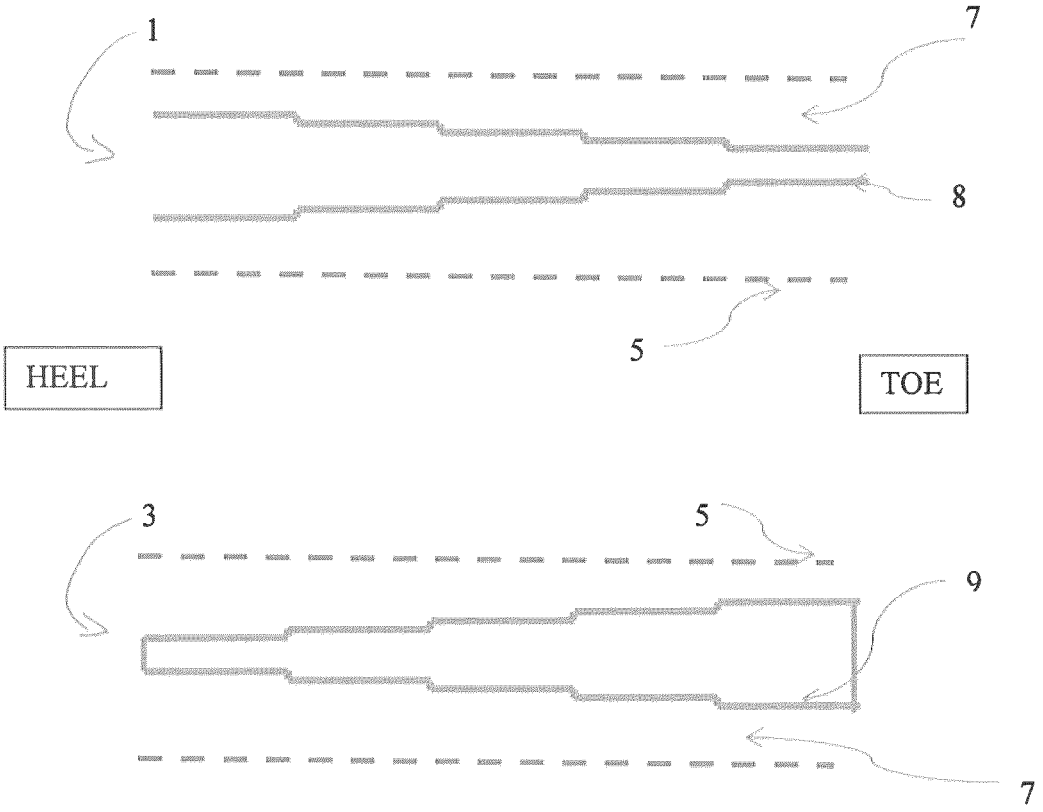
FIG. 2 shows one embodiment of the present disclosure wherein the injection wellbore includes a horizontal tubing string that telescopes axially in one direction, reducing in diameter as it approaches the toe of the well, and the production wellbore includes a tubing string that telescopes axially in the direction opposite to that of the injection tubing.

FIG. 2 illustrates schematically an embodiment of the present disclosure wherein the injection wellbore 1 includes a tubing string 8 that telescopes axially in one direction, in this instance reducing in diameter monotonically as it approaches the toe of the well, whereas the production wellbore 3 includes a tubing string 9 that telescopes monotonically along the axial orientation but in the direction opposite to that of the injection tubing.

Figure 3:
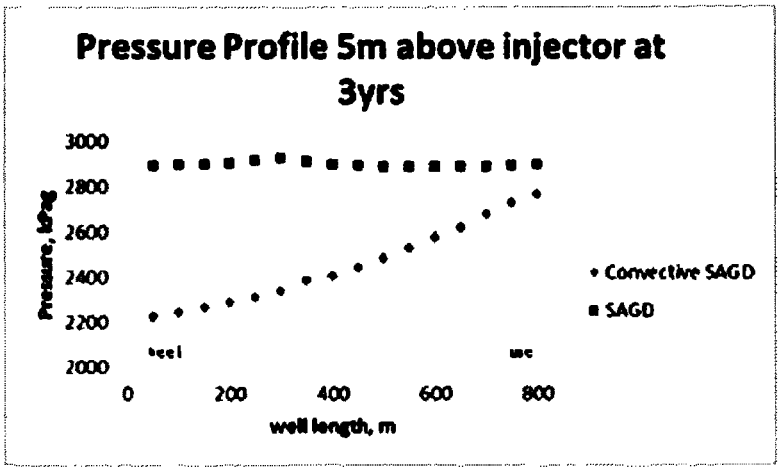
FIG. 3 illustrates typical pressure distributions along the injector and the producer of a well pair for a conventional SAGD process and for the present system and method, which is referred to as Convective SAGD.

FIG. 3 presents pressure profiles from simulations of conventional SAGD and Convective SAGD. These represent the case where injected fluid, such as steam, exits the tubing at the toe of the injector, whence it enters the annular region, or annulus, between the outside of the tubing and the inside of the casing or liner. At this point, the reservoir is exposed to the high pressure steam exiting at the injector toe. In the case of conventional SAGD, this high pressure steam has to be restrained from entering the production well. This is accomplished in conventional SAGD by maintaining an appropriate back pressure at the producer, thereby constraining production levels, but with adverse consequences for productivity. In the case of Convective SAGD, the restraint on flow of injected steam directly downwards to the producer is provided by the narrow annular region near the toe of the producer as a result of the large diameter segment of the telescopic tubing, and does not involve the level of production constraint required for conventional SAGD. As the injected steam moves axially back towards the heel, it encounters progressively increasing resistance to fluid flow in the injector annulus by virtue of the narrowing annular cross-sectional area caused by the outward telescoping of the tubing from toe to heel. This forces more of the steam to enter the reservoir where it mobilizes bitumen, which drains to the producer and into the annular zone within the producer. Note that, in this embodiment, the interior of the tubing within the producer is inoperative. It is the complementarity of axial fluid resistances in the annuli of the injector and producer that governs the flow and displacement of the fluids.

Figure 4:
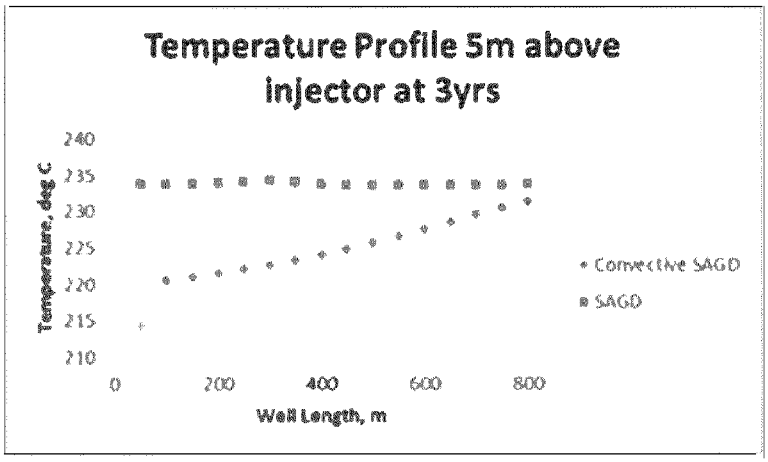
FIG. 4 illustrates typical temperature distributions along the injector and the producer of a well pair for the case of conventional SAGD process (FIG. 1) and for Convective SAGD.

FIG. 4 compares simulations of the resulting temperature distributions for conventional SAGD and for the method of the present disclosure (Convective SAGD). As indicated, temperatures are generally lower for Convective SAGD. In the case shown, which includes the presence of non-condensing gases, this reduced temperature is associated with the presence of non-condensing gases which are being removed at the producer. Removal of the non-condensing gases improves heat transfer within the reservoir and lowers steam requirements. Also, with the lower temperature in the vicinity of the producer, higher oil rates can be achieved by Convective SAGD without drawing down steam into the producer.

Figure 5:
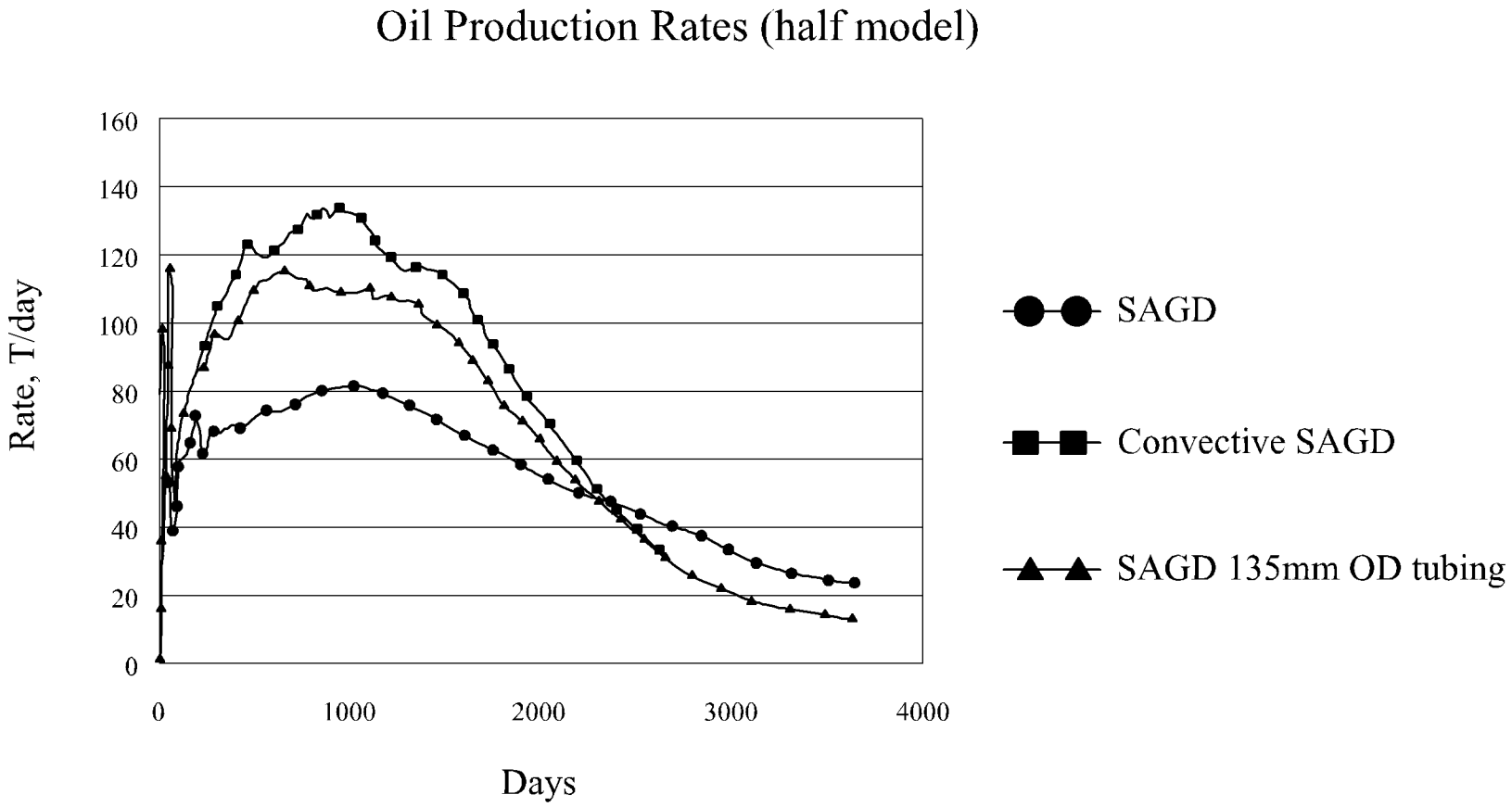
FIGS. 5 and 6 compare the oil production rate and cumulative steam-oil ratio performance of Convective SAGD with that of conventional SAGD.
Figure 6:
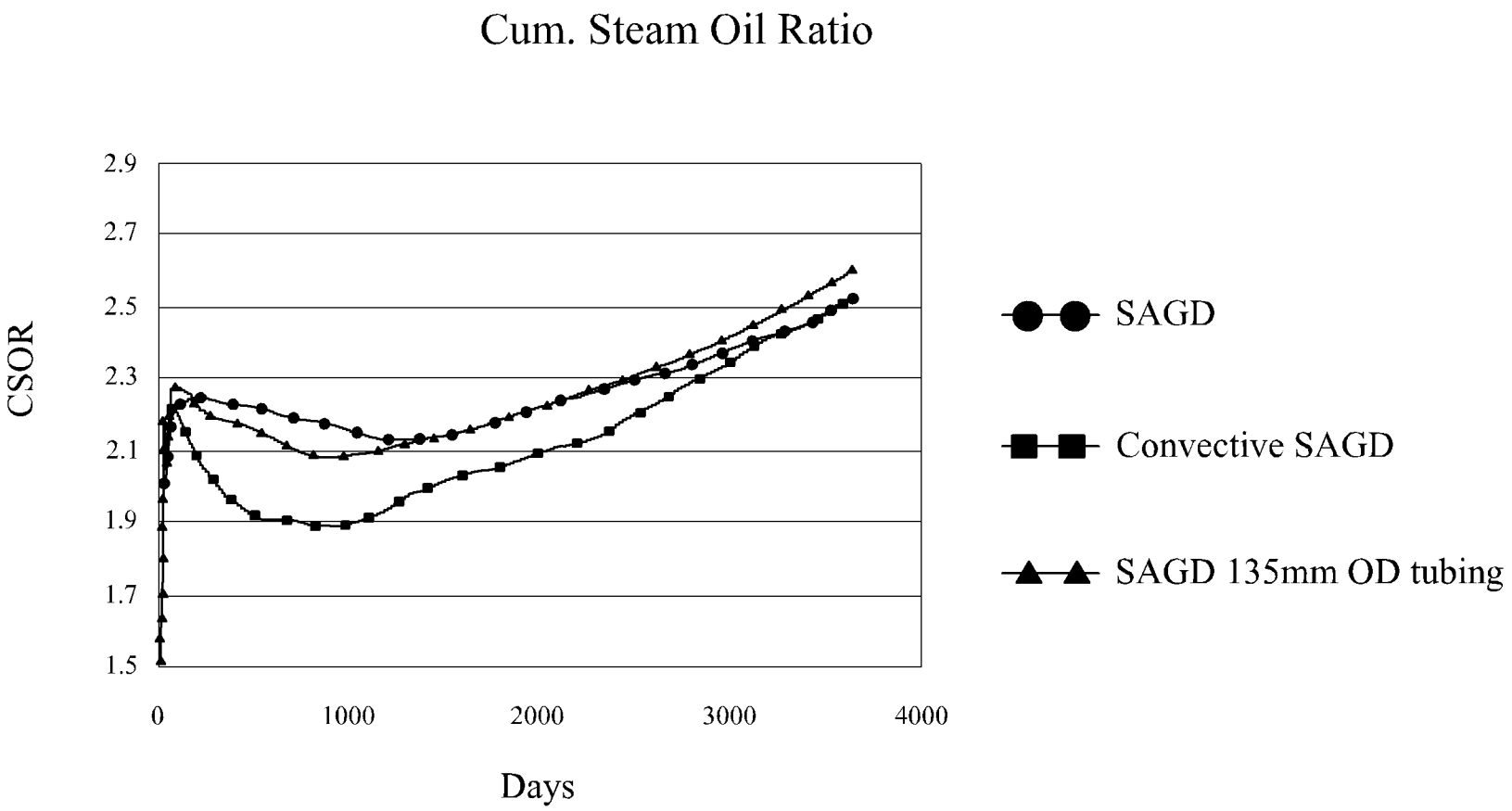

FIGS. 5 and 6 compare performance of Convective SAGD with conventional SAGD for two key metrics—oil production rate and cumulative steam-oil ratio (CSOR). The superiority of the system and method advocated in the present disclosure, is evident. Included in the comparisons of FIGS. 5 and 6 is the case of a conventional SAGD operation wherein a larger diameter tubing which is of uniform diameter (135 mm) throughout is employed. This particular conventional SAGD configuration exhibits improved oil rate relative to that of a conventional SAGD case in which smaller diameter tubing is used (FIG. 5). This occurs as a result of increased annular axial resistance to fluid flow caused by the reduction in annular cross-sectional area. However, even with this improvement using conventional SAGD, performance is still not as good as that achieved with Convective SAGD. The contrast is even more apparent when comparing CSOR performance (FIG. 6). In this instance, utilization of a larger uniform diameter tubing for conventional SAGD operations achieves negligible improvement over conventional SAGD with smaller diameter tubing, and is clearly inferior to the CSOR performance of Convective SAGD.

In one aspect the system and method of the present disclosure may be applied such that the injection and/or production operations are continuous. Alternatively, the system and method of the present disclosure may be applied such that the injection and/or production operations are intermittent, and specifically may be cyclic.

In one aspect, the injection operation may involve the injection of a single fluid or fluid type. In one aspect, the injection operation may involve two or more fluids or fluid types. Where two or more fluids, or fluid types, are being injected, their injection may occur either concurrently or sequentially.

Reference is made to exemplary aspects and specific language is used herein. It will nevertheless be understood that no limitation of the scope of the disclosure is intended. Alterations and further modifications of the features described herein, including well known supporting and ancillary equipment and systems, and additional applications of the principles described herein, which would occur to one skilled in the relevant art and having possession of this disclosure, are to be considered within the scope of this disclosure. Further, the terminology used herein is used for the purpose of describing particular embodiments only and is not intended to be limiting, as the scope of the disclosure will be defined by the appended claims and equivalents thereof. All publications, patents, and patent applications mentioned in this specification are herein incorporated by reference to the same extent as if each individual publication, patent or patent application were each specifically and individually indicated to be incorporated by reference.

What is claimed is:

1. A method of producing viscous hydrocarbons from a subterranean reservoir, comprising:

providing a first well within the subterranean reservoir wherein the well includes a first annular region, defined by an inner surface of an outer wall which has hydraulic access to the subterranean reservoir through said wall, and an outer surface of an inner wall, providing a first axial resistance to fluid flow varier within the first annular region of the first well along at least a portion of a length of the first well, wherein a variation in axial resistance to fluid flow in the first annular region constitutes a first annular axial fluid resistance profile, providing a second well, at least a portion of which is aligned with and spaced apart from the first well, the second well including a second annular region, defined by an inner surface of an outer wall which has hydraulic access to the subterranean reservoir through said wall, and an outer surface of an inner wall, providing a second axial resistance to fluid flow varier within the second annular region of the second well along at least a portion of a length of the second well, wherein a variation in axial resistance to fluid flow in the second annular region constitutes a second annular axial fluid resistance profile, wherein the second annular axial fluid resistance profile is complementary to the first annular axial fluid resistance profile of the first well, injecting one or more mobilizing fluids into the first well, said one or more mobilizing fluids flowing through the first axial resistance to fluid flow varier in the first well, and producing one or both of the one or more mobilizing fluids and mobilized fluids, comprising the viscous hydrocarbons, from the second well through the at least a portion of the second well having second axial resistance to fluid flow varier, and operating the first well and the second well so that gravity drainage and convective displacement are employed concurrently in recovering the viscous hydrocarbons.

2. The method of claim 1 wherein the first annular axial fluid resistance profile is complementary to the second annular axial fluid resistance profile when, i) over an interval of increasing axial resistance to fluid flow in the first well there is a decreasing axial resistance to fluid flow in the second well, or ii) over an interval of decreasing axial resistance to fluid flow in the first well there is an increasing axial resistance to fluid flow in the second well.

3. The method of claim 2 wherein the amount of increase in the axial resistance to fluid flow in one well substantially corresponds to the amount of decrease in the axial resistance to fluid flow in the other well.

4. The method of claim 3 wherein the increase in axial resistance to fluid flow in the one well and the corresponding decrease in axial resistance to fluid flow in the other well are monotonic.

5. The method of claim 3 wherein the increase in axial resistance to fluid flow in the one well and/or the corresponding decrease in axial resistance to fluid flow in the other well are non-monotonic.

6. The method of claim 1 wherein the at least one of the first and second axial resistance to flow variers comprises at least one of:

a length of tubing with a progressive increase or decrease in diameter in the axial direction, wherein the progressive increase or decrease is continuous or step-wise; and a liner, an inner surface of which defines an outer boundary of the first or second annular region, and which contains openings that penetrate a wall of the liner such that the size, shape, configuration and distribution of those openings provide a variation in annular axial fluid resistance when fluids flow in the first or second annular regions.

7. The method of claim 1 wherein the first and second axial resistance to fluid flow variers are the same or different, with the proviso that the first and second annular axial fluid resistance profiles are complementary.

8. The method of claim 1 wherein the viscous hydrocarbons are selected from the group consisting of bitumen, heavy oil, and unmobilized hydrocarbons.

9. The method of claim 1 wherein the injected fluid comprises steam, hot water, light hydrocarbons, or mixtures thereof or one or more of non-condensing gases and surfactants.

10. A system for producing hydrocarbons from a subterranean reservoir, comprising:

a first well within the subterranean reservoir wherein the first well includes a first annular region defined by an inner surface of an outer wall which is configured to have hydraulic access to the subterranean reservoir through said wall, and an outer surface of an inner wall;

a first axial resistance to fluid flow varier within the first annular region of the first well along at least a portion of a length of the first well configured to generate a variation in axial resistance to fluid flow constituting a first annular axial fluid resistance profile;

a second well within the subterranean reservoir wherein the well includes a second annular region defined by an inner surface of an outer wall which is configured to have hydraulic access to the subterranean reservoir through said wall, and an outer surface of an inner wall; and a second axial resistance to fluid flow varier within the second annular region of the second well along at least a portion of a length of the second well, configured to generate a variation in axial resistance to fluid flow constituting a second annular axial fluid resistance profile;

wherein the second annular axial fluid resistance profile is complementary to the first annular axial fluid resistance profile.

11. The system of claim 10 wherein the first annular axial fluid resistance profile is complementary to the second annular axial fluid resistance profile when, i) over an interval of increasing axial resistance to fluid flow in the first well there is a decreasing axial resistance to fluid flow in the second well, or ii) over an interval of decreasing axial resistance to fluid flow in the first well there is an increasing axial resistance to fluid flow in the second well.

12. The system of claim 10 wherein the amount of increase in the axial resistance to fluid flow in one well substantially corresponds to the amount of decrease in the axial resistance to fluid flow in the other well.

13. The system of claim 12 wherein the increase in axial resistance to fluid flow in the one well and/or the decrease in axial resistance to fluid flow in the other well are monotonic.

14. The system of claim 12 wherein the increase in axial resistance to fluid flow in the one well and/or the decrease in axial resistance to fluid flow in the other well are non-monotonic.

15. The system of claim 10 wherein the first and second axial resistance to fluid flow variers comprises at least one of:

a length of tubing with a progressive increase or decrease in diameter in the axial direction, wherein the progressive increase or decrease is continuous or step-wise;

a liner, an inner surface of which defines an outer boundary of the first or second annular region, and which contains openings that penetrate a wall of the liner such that the size, shape, configuration and distribution of those openings provide a variation in annular axial fluid resistance when fluids flow in the first or second annular region.

16. The system of claim 10 wherein the first and second axial resistance to fluid flow variers are the same or different, with the proviso that the first and second annular axial fluid resistance profiles are complementary.

17. The system of claim 10 wherein the viscous hydrocarbons are selected from the group consisting of bitumen, heavy oil, and unmobilized hydrocarbons.

18. The system of claim 10 wherein the injected fluid comprises steam, hot water, light hydrocarbons, or mixtures thereof or one or more of non-condensing gases and surfactants.

* * * * *